United States Patent [19]

Chamlee

[11] 4,304,108

[45] Dec. 8, 1981

[54] SOCK WITH SIMULATED OVEREDGE SHELL STITCH AND METHOD

[75] Inventor: Aubrey K. Chamlee, Sweetwater, Tenn.

[73] Assignee: Crescent Hosiery Mills, Niota, Tenn.

[21] Appl. No.: 61,701

[22] Filed: Jul. 30, 1979

[51] Int. Cl.[3] ..... D04B 15/54

[52] U.S. Cl. ..... 66/138; 66/178 R; 66/172 E; 66/180; 2/239

[58] Field of Search ..... 2/239, 61; 66/178 R, 66/171, 180, 172 R, 172 E, 41, 196, 202; 36/9, 10

[56] References Cited

U.S. PATENT DOCUMENTS

| | | | |
|---|---|---|---|
| 1,079,268 | 11/1913 | Scott | 66/172 |
| 1,192,801 | 7/1916 | Scott | 66/172 |
| 2,211,475 | 8/1940 | Nebel | 66/173 |
| 2,339,963 | 1/1944 | Pierre | 66/173 |
| 2,349,746 | 5/1944 | Morris | 66/172 |
| 2,953,003 | 9/1960 | Crawford | 66/173 X |
| 2,974,508 | 3/1961 | Westmoreland | 66/172 X |
| 3,274,804 | 9/1966 | Thorneburg et al. | 66/171 |
| 3,492,674 | 2/1970 | Poole | 2/239 |
| 3,990,115 | 11/1976 | Nester | 66/172 E X |
| 4,034,580 | 7/1977 | Holder | 66/172 E |
| 4,047,400 | 9/1977 | Thorneburg | 66/171 |

*Primary Examiner*—Ronald Feldbaum

*Attorney, Agent, or Firm*—Bell, Seltzer, Park & Gibson

[57] ABSTRACT

This sock is provided with an outwardly rolled decorative upper edge (13) which is integrally knit with the sock to provide the appearance of a simulated overedge stitch and is formed on a conventional type of circular hosiery knitting machine without requiring extensive modification. The formation of the simulated shell overedge stitch on the knitting machine eliminates the separate step of sewing on an overedge shell stitch, as has been the prior practice. The decorative upper edge is formed of a substantially inelastic yarn (I), a stretchable yarn (S), and an elastic yarn (E). These three yarns are knit in plated relationship in stitch loops in spaced apart wales (W-1 and W-5) of a plurality of successive courses (C-5 through C-8) with the spaced wales being spaced apart by at least two intervening wales (W-2, W-3 and W-4). The inelastic yarn (I) and the elastic yarn (E) float across the intervening wales while the stretchable yarn (S) forms tucks extending across the intervening wales. The floats of the inelastic yarn (I) form a series of relatively large outwardly protruding loops (L) which alternate with a series of smaller outwardly protruding loops (L') to simulate an overedge shell stitch around the upper edge of the sock.

21 Claims, 6 Drawing Figures

SOCK WITH SIMULATED OVEREDGE SHELL STITCH AND METHOD

FIELD OF THE INVENTION

This invention relates generally to a low cut type sock adapted to be worn with low cut shoes and more particularly to such a sock including an outwardly rolled decorative upper edge integrally knit with the initial course of the sock and simulating the appearance of an overedge shell stitch, and to a method of forming the simulated overedge shell stitch on a circular hosiery knitting machine of the type normally used to knit this type of sock.

BACKGROUND OF THE INVENTION

Many low cut type socks are provided with an ornamental or decorative upper edge which is formed by a "shell" type of sewing stitch surrounding the upper edge. This decorative shell stitch top is usually formed of a yarn of different color from the yarn used in knitting the body of the sock. A special sewing machine is used and the operator must stitch completely around the upper edge of the sock to form the decorative shell stitch. The sewing of this overedge shell stitching requires a skilled operator and involves a separate step in the manufacture of the sock so that the cost of producing the sock is increased.

SUMMARY OF THE INVENTION

With the foregoing in mind, it is an object of the present invention to provide a low cut type sock and method of knitting the same whereby an outwardly rolled decorative upper edge is integrally knit with the upper edge of the sock and simulates the appearance of an overedge shell stitch. The simulated overedge shell stitch upper edge is formed during the knitting of the sock on a circular hosiery knitting machine to eliminate the separate sewing operation and to thereby reduce the cost of producing such a sock.

In accordance with the present invention, the method of forming the simulated overedge shell stitch at the upper edge of the sock may be carried out on a conventional type of circular hosiery knitting machine without requiring extensive modification of the machine. The simulated overedge shell stitch extends substantially coextensive with the upper edge of the shoe and is formed in such a manner as to have sufficient stretchability to permit insertion of the foot into the sock and to have sufficient retractability to resiliently maintain the top of the sock in position on the foot.

The simulated shell overedge stitch of the outwardly rolled decorative upper edge is formed of a substantially inelastic yarn, which is relatively large, a stretchable yarn, which is relatively smaller, and an elastic yarn. All three of these yarns are knit in plated relationship in spaced apart single wales of a plurality of successive courses with the single wales being spaced apart by at least two intervening wales. The inelastic yarn and the elastic yarn are floated across the intervening wales while the stretchable yarn forms tucks extending across the intervening wales. The courses of the decorative upper edge are drawn down and rolled outwardly by the plain stitch body yarn loops formed in the initial course of the foot portion of the sock and by the tucks of the stretchable yarn. The floats of the elastic yarn draw the spaced apart wales together so that the floats of the inelastic yarn form relatively large outwardly protruding loops extending over several wales. The elastic yarn stitch loops straighten out so that the stitch loops of the inelastic yarn form smaller outwardly protruding loops in the spaced apart single wales and disposed between the larger loops. The alternating large and small loops simulate an overedge shell stitch around the decorative upper edge of the low cut sock.

Other objects and advantages will appear as the description proceeds when taken in connection with the accompanying drawings, in which.

Figure 5:
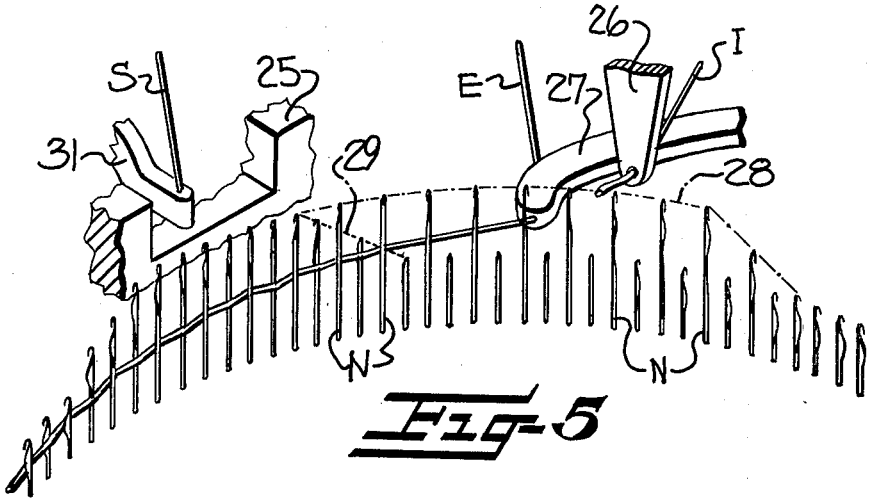
Figure 6:
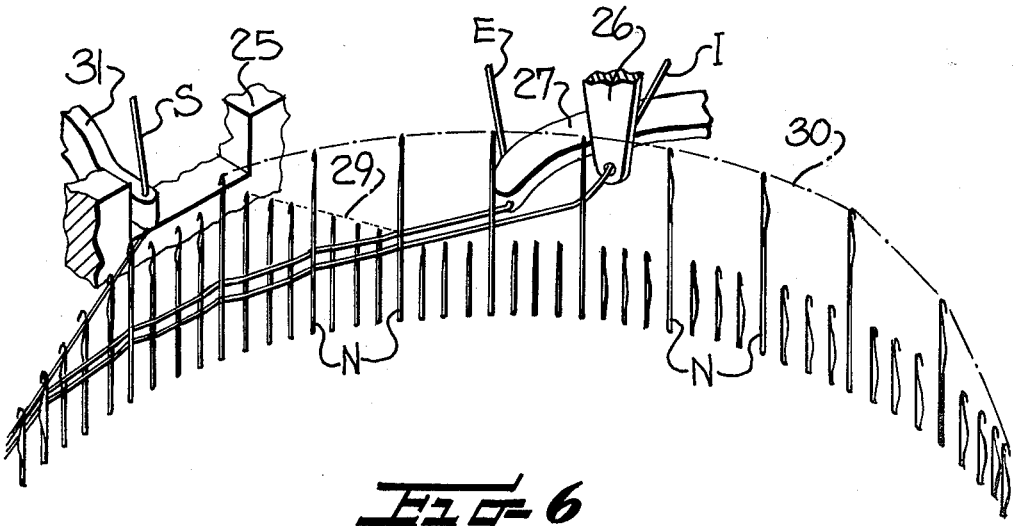

FIG. 5 is a somewhat schematic perspective view of certain parts of the knitting machine and illustrating the manner in which the elastic yarn is fed to the needles in the formation of the first portion to the decorative upper edge; and FIG. 6 is a view similar to FIG. 5 but illustrating the manner in which the three yarns are fed to the needles in the formation of the second portion of the decorative upper edge.

DESCRIPTION OF THE ILLUSTRATED EMBODIMENT

Figure 1:
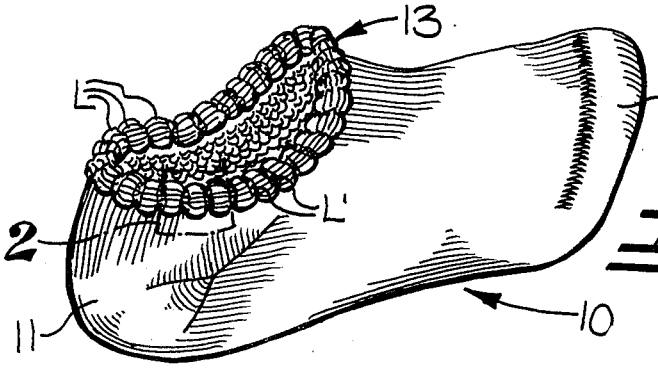
FIG. 1 is a perspective view of the sock of the present invention with the decorative upper edge surrounding the foot opening.

The low cut type sock illustrated in FIG. 1 includes a foot, broadly indicated at 10, which is knit in the conventional manner and includes respective heel and toe portions 11, 12 which are also knit in a conventional manner. A decorative upper edge having the appearance of a simulated overedge shell stitch, broadly indicated at 13, is integrally knit with the initial course of the foot 10, in a manner to be presently described, and defines an opening to receive the foot of the wearer. The low cut type sock of FIG. 1 is adapted to be worn with low cut shoes and the decorative upper edge 13 extends substantially coextensive with the upper edge of the shoe when being worn.

Figure 4:
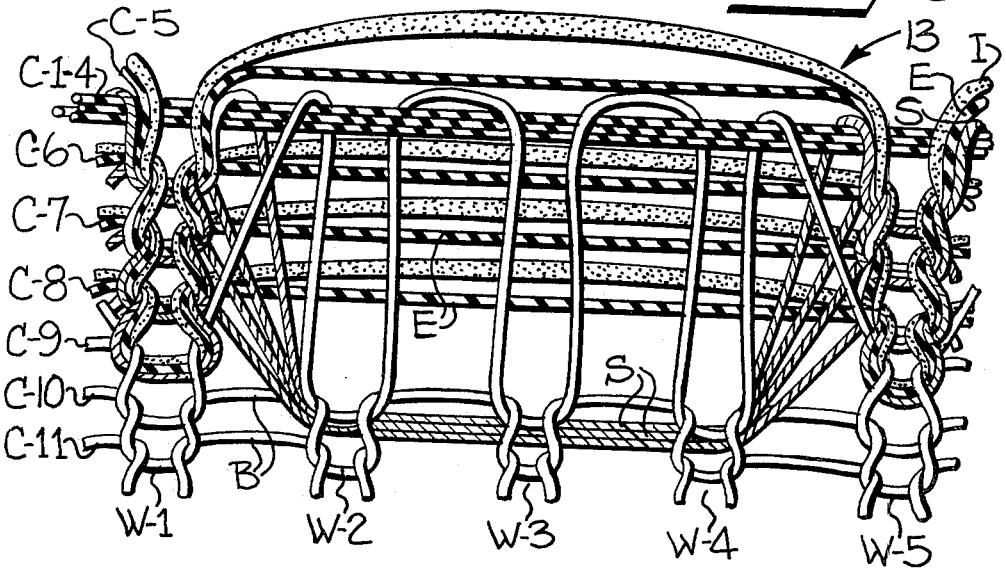
FIG. 4 is a somewhat schematic and greatly enlarged view of the stitch loops, illustrating the manner in which the three yarns are fed to the needles of the knitting machine to form the outwardly rolled decorative upper edge.

The decorative upper edge 13 is formed of a substantially inelastic yarn, indicated at I in FIG. 4, a stretchable yarn, indicated at S, and an elastic yarn, indicated at E. For identification purposes, the inelastic yarn I is speckled, the stretchable yarn S is diagonally lined, and the elastic yarn E is diagonally striped. It is preferred that the inelastic yarn I be relatively large and that the stretchable yarn S be smaller, as will be indicated in the specific example given below. The specific terms used to describe the three yarns are intended to describe various types of yarns which may be used in forming the present decorative upper edge. While specific examples are given below, it is to be understood that other types of yarns may be used. For example, the inelastic yarn can be textured to provide bulk and some slight amount of stretch and retractability. The stretchable yarn and elastic yarn may be of the same or different types as long as they have the ability to stretch and to then retract when relaxed.

As specifically illustrated in FIG. 4, all three of these yarns are knit in plated relationship in spaced apart single wales (such as wales W-1 and W-5 of FIG. 4) of a plurality of successive courses (as indicated in courses C-5 through C-8 of FIG. 4). These single wales (wales W-1 and W-5) are spaced apart by at least two intervening wales (preferably the three wales W-2, W-3 and W-4 illustrated in FIG. 5). The inelastic yarn I and the elastic yarn E are each floated across the intervening wales (wales W-2, W-3 and W-4 in courses C-5 through C-8) and the stretchable yarn S forms tucks extending across the intervening wales (wales W-2, W-3 and W-4 in courses C-5 through C-8).

The initial course (course C-9) of the foot of the sock is formed of body yarn, indicated at B, and plain stitch body yarn loops are formed in every wale. The body yarn stitch loops of the initial course C-9 are drawn through the stitch loops formed of the three plated yarns in wales W-1 and W-5 while the body yarn stitch loops in wales W-2, W-3 and W-4 are drawn down on alternate sides of a plurality of rounds of the elastic yarn E. The rounds of elastic yarn E are inlaid on the needles in the usual manner to form a make-up (indicated at course C-1-4 in FIG. 4) and these rounds of elastic yarn E are held on the needles until the initial course C-9 is formed of the body yarn B.

Figure 2:
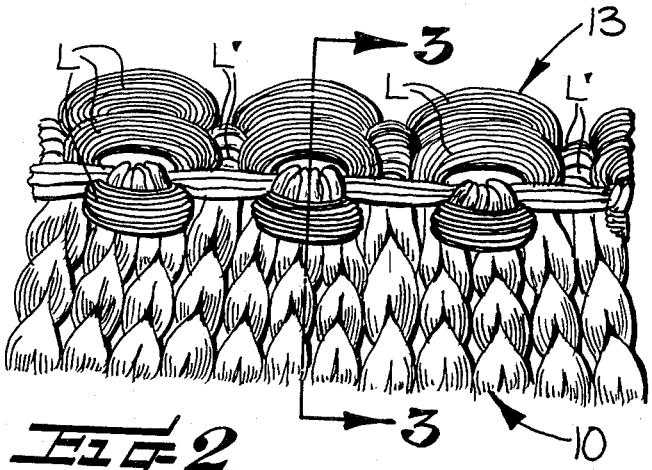
FIG. 2 is an enlarged fragmentary elevational view of a small portion of the simulated overedge shell stitch, being taken in the area of the top encompassed by the dash-dot rectangle 2.
Figure 3:
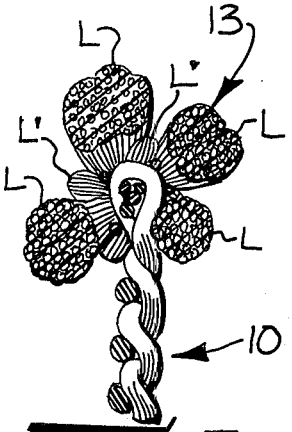
FIG. 3 is a vertical sectional view through the simulated overedge shell stitch and being taken along the line 3—3 in FIG. 2.

The plain stitch body yarn loops in the initial course C-9 of the foot portion and the tucks of the stretchable yarn S drawn down and roll the simulated overedge shell stitch upper edge outwardly (FIG. 3). The floats of the elastic yarn E draw the spaced apart wales W-1 and W-5 together so that the floats of the inelastic yarn I form a series of relatively large outwardly protruding, spaced apart loops in each successive course, which extend over three wales, as indicated at L in FIGS. 1-3. It is to be understood that the stitch loops never appear as schematically illustrated in FIG. 4 because the elastic yarn E is knit under tension and the elastic yarn and the stretchable yarn immediately contract as soon as the stitch loops are shed from the needles. The stretchable yarn and the elastic yarn in the plated yarn stitch loops (wales W-1 and W-5) straighten out in the knit fabric so that the stitch loops of the inelastic yarn form a series of smaller outwardly protruding loops, indicated at L' in FIGS. 1-3, in the spaced apart single wales (wales W-1 and W-5) and between the larger loops L. The smaller loops L' are formed in each successive course and are disposed between the larger loops L.

The combination of the large loops L alternating with the smaller loops L' in the outwardly and downwardly rolled decorative upper edge produces the simulated overedge shell stitch 13 around the upper edge of the low cut sock. The inelastic yarn I is usually of a relatively large denier and contains a large number of filaments which have been textured to add bulk to the yarn. Since the yarn is knit under tension, the relatively large loops L and the smaller loops L' are fairly well defined in the greige stocking, before finishing, as illustrated in FIG. 2. However, the finishing of the sock causes the yarn in the outwardly protruding loops to be relaxed and to become more bulky and fluffy so that the top more closely resembles the appearance of a true overedge shell stitch, as indicated in FIG. 1.

As a specific but nonlimiting example, it has been found that a very attractive decorative upper edge is produced in accordance with the present invention by using a four-ply 150 denier (total of 600 denier) polypropylene yarn as the relatively large inelastic yarn I, and using a two-ply 150 denier (total of 300 denier) polyester yarn as the smaller stretchable yarn S. The elastic yarn E can be of the conventional covered spandex type and the body yarn B can be of any of the well-known stretchable type body yarns so that the foot portion 10 will have sufficient stretchability to fit a range of foot sizes. The outwardly protruding loops L and L' of the inelastic yarn I provide sufficient stretchability to the top to permit the comfortable insertion of the foot in the sock while the elastic yarn E and stretchable yarn S provide sufficient retractability to the top to maintain the same in position on the foot of the wearer.

METHOD OF KNITTING

The decorative upper edge is knit as an integral part of the low cut sock and is knit on a circular hosiery knitting machine of the conventional type including a circular series of needles, indicated at N in FIGS. 5 and 6. The needles N are supported for vertical movement in slots in a needle cylinder, not shown, in the usual manner and the usual needle cams are provided so that the needles form stitch loops at a main yarn feeding and knitting station, indicated by the throat plate 25 in FIGS. 5 and 6. A first auxiliary yarn feeding station, indicated by the vertically movable yarn feed finger 26, is positioned in advance of the main knitting station. A second auxiliary yarn feeding station, indicated by the horizontally movable yarn feed finger 27, is also provided in advance of the main knitting station and adjacent to the first auxiliary yarn feeding station.

The knitting machine is provided with the usual elastic yarn selecting cams, not shown, for selectively raising certain of the needles N high enough to pick up and inlay the elastic yarn E from the feed finger 27. This inlaying of the elastic yarn is illustrated in FIG. 5 with the elastic yarn E being picked up by every other needle N. Every other needle N is being raised by the elastic yarn selecting cams so their upper ends travel along the dotted line path 28 (FIG. 5) while the remaining needles remain in a lower position as they pass beneath the elastic yarn feed finger 27. The needles raised to the dotted line 28 are not raised high enough to clear the latch and the elastic yarn remains on the outside of the raised needles. The elastic yarn E is then interlaced outside of and inside of alternate needles as the lower needles are raised to a tuck level (along dotted line 29) at the main knitting station (throat plate 25). The alternate needles are raised to tuck level at the main station because the right-hand stitch cam or shed cam is moved outwardly to inoperative position.

The usual needle selector mechanism, not shown, is provided in advance of the first and second auxiliary yarn feeding stations to selectively raise certain of the needles N upwardly to the latch clearing or shed level, that is, with any stitch loops on the needles being positioned below the latches thereof.In FIG. 6, the selector mechanism, not shown, is illustrated as being operable to raise every fourth needle to shed level so that the upper ends of the raised needles travel along a dotted line 30 as they move by the first and second auxiliary yarn feeding stations. Thus, every fourth needle is raised high enough to pick up the inelastic yarn I and the elastic yarn E while the three intervening needles remain in a lower position and do not pick up these yarns. The inelastic yarn I and the elastic yarn E are then floated on the inside of the three intervening needles as all needles are raised along the dotted line 29 at the main knitting and yarn feeding station (throat plate 25).

To begin the knitting of the decorative upper edge (FIG. 5), the needle cylinder is rotated with the needles N being raised in a 1×1 manner by the usual elastic yarn cams, not shown, so that every other needle N is raised along the dotted line 28 to pick up the elastic yarn E from the yarn feed finger 27. The elastic yarn E is thus laid in front of or outside of every other needle while it is floated on the inside of the intervening or remaining needles when the low needles are raised along the dotted line 29 at the main yarn feeding station. The elastic yarn may be inlaid in this manner for one or more rotations of the needle cylinder and preferably is inlaid for four rotations of the needle cylinder, so that four strands of elastic yarn E are inlaid to form the "make-up," as illustrated at courses C-1-4 of FIG. 4. This is the conventional method of inlaying elastic yarn to provide a make-up to begin the knitting of a sock and the body yarn is then normally fed to and forms knit stitch loops on all needles so that the initial stitch loops of the first course are drawn downwardly on opposite sides of the rounds of inlaid elastic yarn. However, in accordance with the present invention, the three yarns are fed to and knit in plated relationship on spaced apart needles while the intervening needles do not knit but either float or tuck the yarn to form the decorative upper edge.

During the fifth rotation of the needle cylinder, the stretchable yarn S is fed to all of the needles (FIG. 6) through a yarn feed finger 31 at the throat plate 25 while the elastic yarn E is fed to every fourth needle and floats inside of the intervening three needles, and the inelastic yarn I is also fed to every fourth needle and floats inside of the three intervening needles, as illustrated in FIG. 6. During the knitting of the courses C-5 through C-8, formed during the next four rotations of the needle cylinder, every fourth needle is raised to shed level, passing along dotted line 30, and receives all three yarns in their hooks. When these fourth needles are lowered to stitch forming level at the main yarn feeding station, plain stitch loops of all three yarns in plated relationship are formed in every fourth wale, as illustrated in wales W-1 and W-5 in FIG. 4. At the same time, the yarns E and I are positioned on the inside of the three intervening needles and form floats extending across the wales formed by these three intervening needles (wales W-2, W-3 and W-4). At the same time, the stretchable yarn S is fed to all needles at the throat plate 25 and stitch loops are formed only on every fourth needle because the three intervening needles are raised to tuck level (along dotted line 29) so that the stretch yarn S is drawn downwardly by the intervening needles to stitch drawing level and forms tucks during each of these four rotations of the needle cylinder.

During the ninth rotation of the needle cylinder, to form the course C-9 of FIG. 4, the auxiliary yarn feed fingers 26 and 27 are moved to the inoperative position and the yarn feed finger 31 is also raised to inoperative position. Another yarn feed finger, not shown, is lowered into operative position at the throat plate 25 to feed the body yarn B to all needles. Also, the right-hand stitch cam or shed cam is moved inwardly to the operative position so that all needles are raised to shed level before passing the throat plate 25 and so that all needles pick up and form plain stitch loops of the body yarn B to knit the initial course of the top of the sock, in the manner illustrated in course C-9 of FIG. 4.

As this initial course C-9 of the foot is knit, the tucks of the stretch yarn S are shed as well as the interlaced rounds of elastic yarn forming the make-up and the decorative upper edge is drawn downwardly and rolled outwardly. The body yarn is continuously fed to and forms plain stitch loops on all of the needles at the main yarn feeding station (throat plate 25) to form the plain courses (as illustrated in courses C-10 and C-11 of FIG. 4) and to knit the foot 10 of the sock in the usual manner.

Thus, an attractive, ornamental simulated overedge shell stitch is integrally formed with the upper edge of the foot of the low cut sock and during the knitting of the low cut sock so that a separate operation is not required to form an overedge shell stitch.

In the drawings and the specification, the best mode presently contemplated for the practice of this invention is disclosed. However, it should be recognized that certain variations in detail may be adopted while continuing to practice the essence of this invention. Therefore, the specification is to be read broadly and in a descriptive sense only and not for purposes of limitation, the scope of the invention being defined in the claims.

That which is claimed is:

1. In a low cut type sock adapted to be worn with low cut shoes and comprising a foot knit of body yarn, said foot including an initial course knit of plain stitch body yarn loops in every wale, the combination therewith of an outwardly rolled decorative upper edge integrally knit with said initial course and defining an opening to receive the foot of the wearer, said upper edge being characterized by a simulated overedge shell stitch appearance and comprising a plurality of successive courses knit with elastic yarn and substantially inelastic yarn, said inelastic yarn defining a series of relatively large outwardly protruding, spaced apart loops and a series of smaller outwardly protruding loops disposed between said large loops in each of said successive courses, said loops being formed by said inelastic yarn and said elastic yarn being knit together in plated relationship in each of said courses with said large loops being formed by said yarns being floated across a plurality of adjacent wales and said smaller loops being formed by plated stitch loops of said yarns in the intervening wales, said large and smaller loops simulating an overedge shell stitch around the upper edge of said low cut sock.

2. A sock according to claim 1 including a plurality of rounds of elastic yarn inlaid in the initial stitch loops of the plated two yarns in said intervening wales and in said plain stitch body yarn loops of said initial course of said foot portion.

3. A sock according to claim 2 wherein said elastic yarn is inlaid for four rounds.

4. A sock according to claim 1 or 2 wherein said plurality of successive courses of said outwardly rolled decorative upper edge comprises four successive courses.

5. A sock according to claim 1 or 2 wherein said intervening wales are spaced apart by three adjacent wales.

6. A sock according to claim 1 or 2 wherein said inelastic yarn is substantially two times as large as said body yarn.

7. A sock according to claim 1 or 2 wherein said inelastic yarn is a different color from said body yarn.

8. A sock according to claim 1 or 2 wherein said plurality of successive courses of said outwardly rolled decorative upper edge comprises four successive courses, and wherein said intervening wales are spaced apart by three adjacent wales.

9. In a low cut type sock adapted to be worn with low cut shoes and comprising a foot knit of body yarn, said foot including an initial course knit of plain stitch body yarn loops in every wale, the combination therewith of an outwardly rolled decorative upper edge integrally knit with said initial course and defining an opening to receive the foot of the wearer, said upper edge being characterized by a simulated overedge shell stitch appearance and comprising a plurality of successive courses knit with elastic yarn, stretchable yarn, and substantially inelastic yarn, said inelastic yarn defining a series of relatively large outwardly protruding, spaced apart loops and a series of smaller outwardly protruding loops disposed between said large loops in each of said successive courses, said loops being formed by said inelastic yarn and said elastic yarn being knit together in plated relationship in each of said courses with said large loops being formed by said yarns being floated across a plurality of adjacent wales and said smaller loops being formed by plated stitch loops of said yarns in the intervening wales, and said stretchable yarn being knit in plated relationship with said inelastic and said elastic yarn in said intervening wales and forming tucks extending across said plurality of adjacent wales to aid in rolling said decorative upper edge outwardly, said large and smaller loops simulating an overedge shell stitch around the upper edge of said low cut sock.

10. A sock according to claim 9 including a plurality of rounds of elastic yarn inlaid in the initial stitch loops of the plated two yarns in said intervening wales and in said plain stitch body yarn loops of said initial course of said foot portion.

11. A sock according to claim 10 wherein said elastic yarn is inlaid for four rounds.

12. A sock according to claim 10 or 11 wherein said plurality of successive courses of said outwardly rolled decorative upper edge comprises four successive courses.

13. A sock according to claim 10 or 11 wherein said intervening wales are spaced apart by three adjacent wales.

14. A sock according to claim 10 or 11 wherein said inelastic yarn is substantially two times as large as said stretchable yarn.

15. A sock according to claim 10 or 11 wherein said inelastic yarn and said stretchable yarn are the same color and of a different color from said body yarn.

16. A sock according to claim 10 or 11 wherein said plurality of successive courses of said outwardly rolled decorative upper edge comprises four successive courses, and wherein said intervening wales are spaced apart by three adjacent wales.

17. In a low cut type sock adapted to be worn with low cut shoes and comprising a foot knit of body yarn and including heel and toe portions, and said foot including an initial course knit of plain stitch body yarn loops in every wale, the combination therewith of an outwardly rolled decorative upper edge integrally knit with said initial course and defining an opening to receive the foot of the wearer, said upper edge being characterized by a simulated overedge shell stitch appearance extending substantially coextensive with the upper edge of the shoe and being sufficiently stretchable to permit insertion of the foot and being sufficiently retractable to resiliently maintain said top in position on the foot, said decorative upper edge being formed of substantially inelastic yarn, stretchable yarn, and elastic yarn, said inelastic and elastic yarns being knit in plated relationship in stitch loops in spaced apart wales of a plurality of successive courses, said spaced apart wales being separated by at least two intervening wales, said inelastic yarn and said elastic yarn floating across said at least two intervening wales, and said stretchable yarn forming tucks extending across said at least two intervening wales, said plurality of courses of said decorative upper edge being drawn down and rolled outwardly by said plain stitch body yarn loops in said initial course of said foot portion and said tucks of said stretchable yarn while said floats of said elastic yarn draw said spaced apart wales together so that said floats of said inelastic yarn form a series of relatively large outwardly protruding loops in each of said plurality of courses, the elastic yarn stitch loops in said spaced apart wales being straightened out so that the stitch loops of said inelastic yarn form a series of smaller outwardly protruding loops in said spaced apart wales, said smaller loops being disposed between said larger loops and together simulating an overedge shell stitch around the upper edge of said low cut sock.

18. A method of knitting a low cut type sock on a circular hosiery knitting machine including a circular series of needles, a main yarn feeding and knitting station, a pair of auxiliary yarn feeding stations positioned in advance of said main yarn feeding and knitting station, and needle selecting means in advance of said pair of auxiliary yarn feeding stations, said method including the steps of forming an outwardly rolled decorative upper edge integrally knit with the upper edge of the sock, said upper edge being characterized by a simulated overedge shell stitch appearance and being sufficiently stretchable to permit insertion of the foot and being sufficiently retractable to resiliently maintain the top of the sock in position on the foot, said decorative upper edge being formed by feeding an elastic yarn at one of said auxiliary yarn feeding stations while selecting needles to inlay the elastic yarn outside of every other needle and inside of the remaining needles without knitting for a plurality of rotations of said needle cylinder, then feeding a substantially inelastic yarn at the other of said auxiliary yarn feeding stations while selecting needles spaced apart by at least two needles to pick up and knit said inelastic yarn and while floating the inelastic yarn inside of the intervening needles for a plurality of rotations of said needle cylinder, and while continuing to feed the elastic yarn at said one of said auxiliary yarn feeding stations but then feeding the elastic yarn to the same needles which pick up and knit the inelastic yarn and floating the elastic yarn inside of the intervening needles, then discontinuing the feeding of the elastic and inelastic yarns at the auxiliary yarn feeding stations, and while feeding a body yarn to all needles at said main feeding station and forming plain stitch loops on every needle to form an initial course of the foot of the sock and while shedding the floated yarns from the needles so that the plain stitch body yarn loops in the initial course of the foot portion draw down and roll the decorative upper edge outwardly and the elastic yarn draws the spaced apart wales together so that the floats of the inelastic yarn form relatively large outwardly protruding loops simulating an overedge shell stitch around the upper edge of the low cut sock, and then continuing to knit the body yarn on all needles to form the remainder of the foot of the sock.

19. A method according to claim 18 including the step of feeding a stretchable yarn to all needles at said main yarn feeding and knitting station and forming stitch loops on the needles with the inelastic and elastic yarns on the outside thereof and forming tucks on the needles with the inelastic and elastic yarns on the inside thereof so that the tucks of the stretchable yarn also aid in drawing down and rolling outwardly the decorative upper edge.

20. A knit, low-cut, footlet-type sock adapted to be worn inside a low-cut shoe and substantially covered thereby with the exception of an exposed decorative welt, said welt comprising:

(a) a scalloped surface extending around at least a portion of said welt;

(b) said scalloped surface comprising:

(i) a plurality of courses of an elastic yarn and a second yarn knitted in plated relationship;

(ii) each of said courses including knit stitches separated by a band of at least two adjacent float stitches;

(c) whereby the combination of said elastic yarn and said knitting construction cause relatively wide bands or walewise ribs of raised fabric separated by a relatively narrow band of base fabric.

21. A method for forming a knit, low-cut, footlet-type sock with an exposed decorative welt comprising the steps of:

(a) laying in a plurality of strands of elastic material, knitting at least one course to tie in said elastic strands, and holding said strands and initial course on the transfer needles of the machine;

(b) forming a welt area by knitting a plurality of courses of an elastic yarn under tension and a second yarn in plated relationship;

(c) at least a portion of each course including knit stitches, in which loops are formed on the needles and cast off, separated by at least two adjacent wales of float stitches formed on the inside surface of said fabric;

(d) folding over the welt portion and transferring the initial course of said welt area into the bottom course to form an upper decorative edge; and (e) knitting the remainder of the heel, foot, and toe portions of the sock according to conventional techniques.

* * * * *